US009835182B2

(12) United States Patent
Anderson

(10) Patent No.: US 9,835,182 B2
(45) Date of Patent: Dec. 5, 2017

(54) HYDRAULIC CYLINDER DRIVE SYSTEM

(71) Applicant: Paul S. Anderson, Milwaukie, OR (US)

(72) Inventor: Paul S. Anderson, Milwaukie, OR (US)

( * ) Notice: Subject to any disclaimer, the term of this patent is extended or adjusted under 35 U.S.C. 154(b) by 302 days.

(21) Appl. No.: 14/639,761

(22) Filed: Mar. 5, 2015

(65) Prior Publication Data

US 2016/0258451 A1 Sep. 8, 2016

(51) Int. Cl.

| | |
|---|---|
| ***F15B 15/14*** | (2006.01) |
| ***F15B 15/04*** | (2006.01) |
| ***F15B 11/20*** | (2006.01) |

(52) U.S. Cl.

CPC ..... *F15B 15/04* (2013.01); *F15B 11/20* (2013.01); *F15B 2211/6336* (2013.01); *F15B 2211/7107* (2013.01); *F15B 2211/76* (2013.01); *F15B 2211/782* (2013.01)

(58) Field of Classification Search

CPC .... F15B 15/04; F15B 11/20; F15B 2211/782; F15B 2211/7107; F15B 2211/76; F15B 2211/6336

See application file for complete search history.

(56) References Cited

U.S. PATENT DOCUMENTS

| | | | | |
|---|---|---|---|---|
| 3,815,766 | A * | 6/1974 | Carlson | F15B 11/20 212/286 |
| 4,198,193 | A * | 4/1980 | Westerlund | F04B 7/0096 417/517 |
| 4,308,719 | A * | 1/1982 | Abrahamson | F01B 23/08 60/325 |
| 4,979,884 | A * | 12/1990 | Letarte | F04B 7/0026 137/874 |
| 6,193,002 | B1 * | 2/2001 | Paakkunainen | B62D 57/02 180/8.1 |
| 7,407,022 | B2 * | 8/2008 | Mundell | E21B 21/066 166/335 |
| 2001/0032542 | A1 * | 10/2001 | Heikkila | B66C 23/84 91/508 |
| 2015/0208586 | A1 * | 7/2015 | Lang | A01F 15/0825 100/2 |

* cited by examiner

*Primary Examiner* — Michael Zarroli
(74) *Attorney, Agent, or Firm* — Mark S Hubert

(57) ABSTRACT

A drive system with multiple hydraulic cylinders applying torque to the drive shaft of a machine. Each cylinder is attached at one end to the frame of the machine by a clevis that pivots and the other end is rotationally connected to a shaft fixed to a crank arm, fixed to the drive shaft. Each cylinder either pushes or pulls-the crank arm shaft producing torque on the drive shaft in the form of a moment about centerline. As the drive shaft rotates, each cylinder alternately pushes and pulls on the crank arm shaft, depending on the rotational position of the crank arm with respect to the cylinders. The direction of force applied by each hydraulic cylinder is determined by an electro/hydraulic direction control valve, driven by a programmable logic controller, using a signal from a sensor to detect the rotational position of the drive shaft.

9 Claims, 10 Drawing Sheets

Torque = F1 x L1 = F1 x R1 x SIN(b1)

HYDRAULIC CYLINDER DRIVE SYSTEM

The present invention relates to an improved hydraulic cylinder motor adapted to drive a high torque slow speed rotary shaft of large commercial or industrial equipment such as found in industrial shredders, waste reducers, delumpers, mixers and the like.

BACKGROUND OF THE INVENTION

The current invention relates to driving a rotary shaft of large, high torque, low speed machines. Many times these types large industrial machines use hydraulic drive systems in place of standard electric drives because these machines are frequently used in portable adaptations on trailers, or in wet, dirty environments where electric motors are undesirable or where an alternate source of motive power, such as a diesel piston engine exists. Aside from these situations, frequently hydraulic drive systems are desirable over standard electric drive systems because of the added expense of the gear reducers needed to convert the high speed and low torque of a standard electric motor to the low speed and high torque required by the machine.

One of the easiest ways of converting the high speed and low torque of a diesel piston engine to the low speed and high torque required by these machines is through a hydraulic drive system. In the majority of these applications, large displacement, multi cylinder, radial piston hydraulic motors are used to drive the machines. These motors are very complex with many precision, tight tolerance machined parts that make them expensive to purchase and expensive to repair if damaged. Because of the numbers of these many tight tolerance parts involved, these motors can be destroyed in seconds if there are contaminants in the hydraulic fluid. Even though the clearances between parts are very tight (small), because there are so many parts there is a large amount of internal leakage which generates a lot of heat.

Henceforth, a new hydraulic cylinder motor adapted to drive a high torque slow speed rotary shaft would fulfill a long felt need with many different industrial and commercial applications. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a means of driving high torque, low speed machines with a much simpler, less expensive, and more rugged system. Instead of the high precision, pistons, rollers, cams and valves used in existing radial piston motors, this drive system utilizes simple, off-the-shelf hydraulic valves, sensors, and hydraulic cylinders arranged in a unique manner to provide high torque to the drive shaft. The organization and method of operation may best be understood by reference to the following description taken in connection with accompanying drawings wherein like reference characters refer to like elements. Other objects, features and aspects of the present invention are discussed in greater detail below.

It has many of the advantages mentioned heretofore and many novel features that result in a new hydraulic cylinder drive system which is not anticipated, rendered obvious, suggested, or even implied by any of the prior art, either alone or in any combination thereof. The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
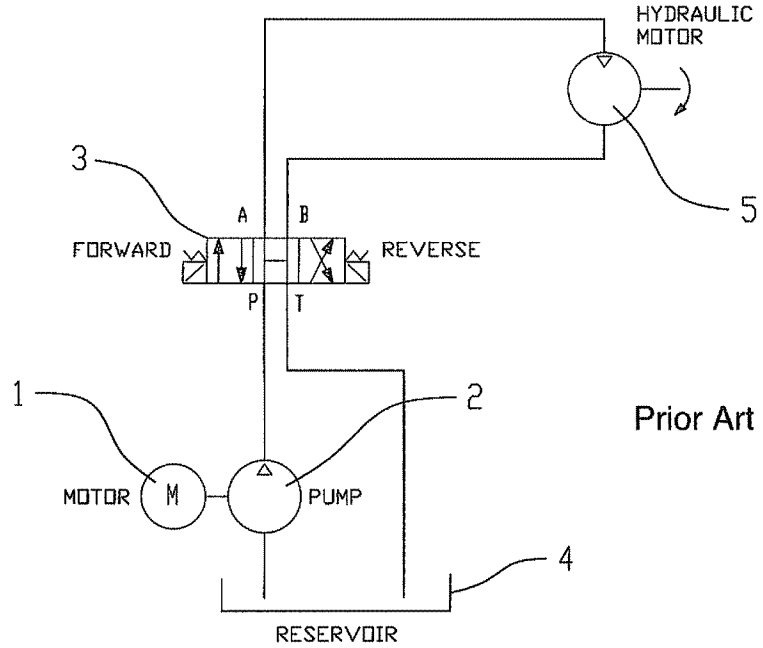
FIG. 1 is a simplified schematic of a typical hydraulic drive system using a standard radial piston hydraulic motor for reference.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As used herein the term "double acting hydraulic cylinder" refers to a hydraulic cylinder having an extendable and retractable cylinder arm driven in either direction by the force of a hydraulic fluid.

As used herein the term "approximately 90 degrees apart" with respect to the orientation of the linear axes of the pair of hydraulic cylinders refers to the optimal design configuration for the cylinders with the crank arm at two different positions 180 degrees apart. As the crank arm rotates the included angle between the linear axes of the pair of hydraulic cylinders fluctuates within 10 degrees of 90 degrees.

As used herein the term "drive shaft position indicator" is synonymous with "crank arm position indicator" as the drive shaft and crank arm are rigidly affixed together so as to function in a locked rotational configuration.

As used herein "drive shaft position indicator" encompasses any of a plethora of systems that are well known in the field of rotational mechanical equipment to determine and relay rotational positions such as hall effect sensors, limit switches, stroboscopes, shaft encoders and the like.

As shown in FIG. 1, the simplest prior art open loop hydraulic drive system consists of a driving force (an electric motor 1 or optionally, diesel engine, not illustrated) that drives a pump 2, a directional control valve 3, a hydraulic reservoir 4, and a hydraulic motor 5. Other components typically included but not shown here for clarity, are case drains, pressure and return filters, a pressure relief valve, and a hydraulic fluid cooler. In such a system the driving force drives the pump 2 which forces hydraulic fluid through the direction control valve 3 and into the hydraulic motor 5 which converts the pressure of the hydraulic fluid into rotational torque. Both the pump 2 and hydraulic motor 5 are positive displacement devices. By choosing a motor 5 having a much larger displacement per revolution than that of the pump 2, (requiring more fluid volume to process through the motor to generate one revolution than through the pump to generate one revolution) large speed reduction and torque increase can be achieved by this system without the need for gear reducers, torque multipliers, etc.

Also common are closed loop systems that use variable displacement pumps that can reverse flow so that a direction control valve is not needed. Although the implementation of various hydraulic systems is different, the basic concept of driving a large displacement motor with a small displacement pump to achieve slow shaft speeds and high torque is the same.

The present disclosure concerns embodiments of a novel hydraulic drive system that utilizes two or more hydraulic cylinders for applying torque to the drive shaft of a machine instead of a typical hydraulic motor. Basically, each hydraulic cylinder is attached at one end to the frame of the machine by a clevis mount that pivots and the other end is rotationally connected to a shaft that is fixed to a crank arm that is fixed to the drive shaft. Each cylinder can either push or pull on the crank arm shaft so as to produce a torque on the drive shaft in the form of a moment about the centerline of the drive shaft. As the drive shaft rotates, each cylinder alternately pushes and pulls on the crank arm shaft, depending on the rotational position of the crank arm with respect to the cylinders. The direction of force applied by each hydraulic cylinder is determined by an electro/hydraulic direction control valve which is driven by a programmable logic controller (commonly referred to as a PLC) which uses a signal from a sensor to detect the rotational position of the drive shaft. This is best explained in reference to FIGS. 2-10.

Figure 2:
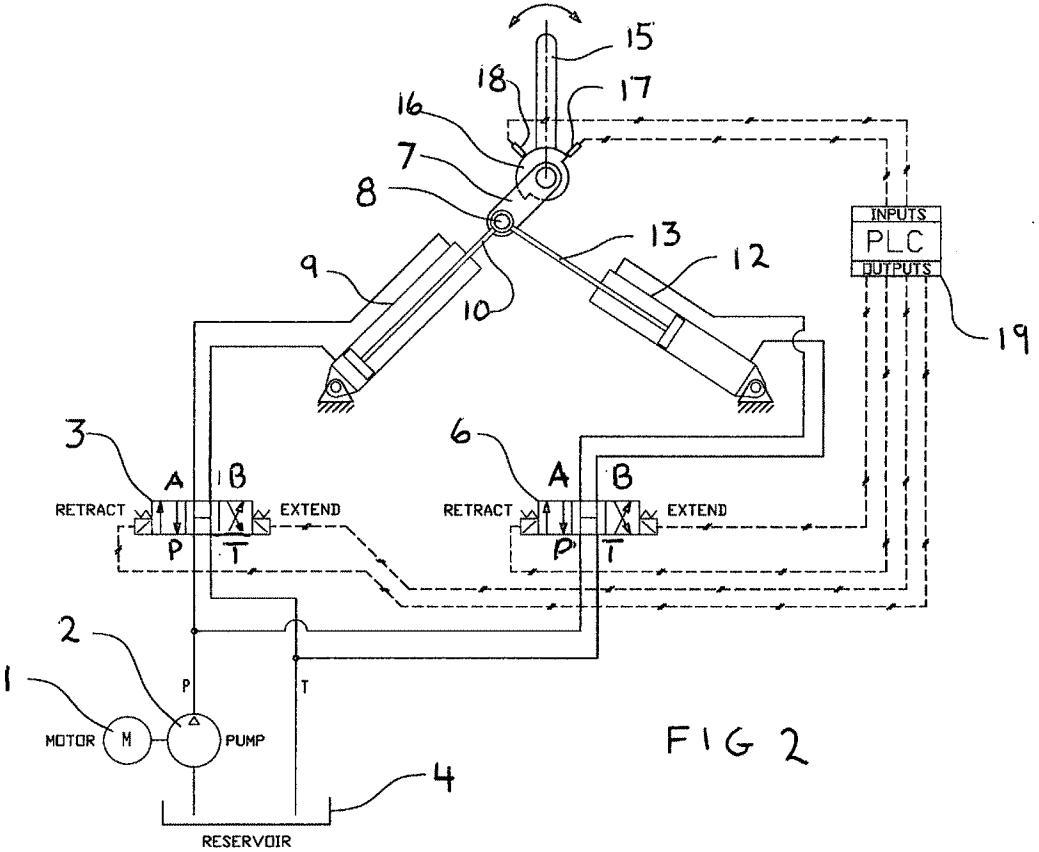
FIG. 2 is a simplified hydraulic schematic of the two cylinder preferred embodiment of this invention.

Referring to FIG. 2, some of the components of the overall hydraulic drive are the same as those shown in FIG. 1, which is of existing hydraulic drive technology. The electric motor 1 or diesel engine that drives a pump 2, the reservoir 4, and the direction control valve 3 are the same. Here, in place of the hydraulic motor 5, there is now a crank 7 with two hydraulic cylinders 9 & 12 angularly connected to it 90 degrees apart, a drive shaft position indicator disc 16 mounted to the drive shaft 15, and two drive shaft position sensors 17 & 18. There is also a second hydraulic direction control valve 6 and a PLC 19 to control the valves 3 & 6 for the second hydraulic cylinder 12. Although the FIG. 2 schematic is more complicated than FIG. 1 which utilizes a hydraulic motor, the overall mechanical complexity and cost of the FIG. 2 system is much less due to the very high complexity and cost of the radial piston hydraulic motor 5 in FIG. 1.

Figure 3:
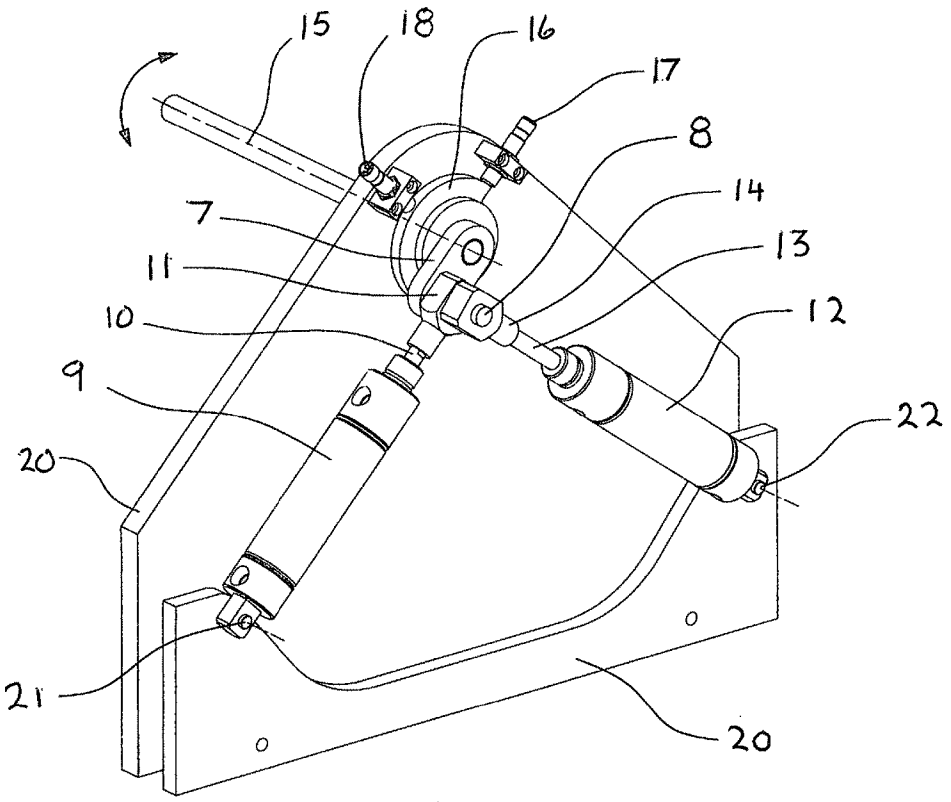
FIG. 3 is an isometric view of the two cylinder preferred embodiment of this invention.

While FIG. 2 is a schematic representation of the entire drive system, FIG. 3 is an isometric view of the components making up the motor portion of the hydraulic circuit. Referring to FIG. 3, at the lower end of the motor frame 20, the two hydraulic cylinders 9 & 12 are attached to the frame 20 by rotatable pins 21 & 22, in a manner that allows them to pivot on axis parallel to the drive shaft 15 axis. Attached to the rods of the cylinders are rod ends 11 & 14 that are connected to a shaft 8 in a manner that allows the shaft 8 to rotate freely inside the rod ends 11 & 14. In most cases one or more roller bearings would be used in each rod end to allow free rotation while carrying the high load applied by the hydraulic cylinders. The shaft 8 is rigidly fixed to the crank arm 7 and the crank arm 7 is rigidly fixed to the drive shaft 15 which is rotationally connected to the motor frame 20. Again, in most cases, one or more roller bearings would be used where the drive shaft 15 attaches to the frame 20 to allow free rotation while carrying the high load applied to the drive shaft 15 by the hydraulic cylinders acting on the crank arm shaft 8. Also attached to the drive shaft 15 is the drive shaft position indicator disc 16 that is timed to the crank arm 7. The two shaft position sensors 17 & 18 are fixed to the motor frame 20 in positions such that, together with the drive shaft position indicator disc 16, they can detect the shaft positions where each hydraulic cylinder is fully extended and fully retracted. An alternative to the drive shaft position indicator disc 16 and sensors 17 & 18 would be the use of a rotary shaft encoder.

The operable assembly detecting and signaling the PLC 19 of the shaft position, that incorporates the drive shaft position indicator disc 16 timed to the crank arm 7 and that is operably coupled to the two shaft position sensors 17 and 18 (or the alternative rotary shaft encoder) is known as a positional sensing unit As the drive shaft turns each cylinder experiences two physical locations, 180 degrees apart, where it does not provide any torque to the drive shaft; once when it is fully extended, and the other when it is fully refracted. At these two places the line of action of the cylinder is coincident with the center line of the drive shaft and thus the perpendicular component of the distance between the crank journal and the drive shaft is zero. These two positions are also the positions where the cylinder must switch the direction of force in order to keep the drive shaft turning in the same direction. This change in direction of force is achieved by de-energizing one of the direction control valve's solenoids and energizing the other.

Referring back to FIG. 2, the signal wires of the sensors 17 & 18 are connected to the inputs of the PLC 19. Depending on the states of the inputs and the logic of its program, the PLC 19 changes the states of its outputs that are connected to each of the hydraulic direction control valves 3 & 6 such that pressurized hydraulic fluid is sent to the proper end of each hydraulic cylinder 9 & 12 to produce a torque on the drive shaft 15 in the desired direction. The input from sensor 17 is used to determine the output sent to direction control valve 3 and thus the direction of force exerted by hydraulic cylinder 9 while the input from sensor 18 is used to determine the output sent to direction control valve 6 and thus the direction of force exerted by hydraulic cylinder 12.

Figure 4:
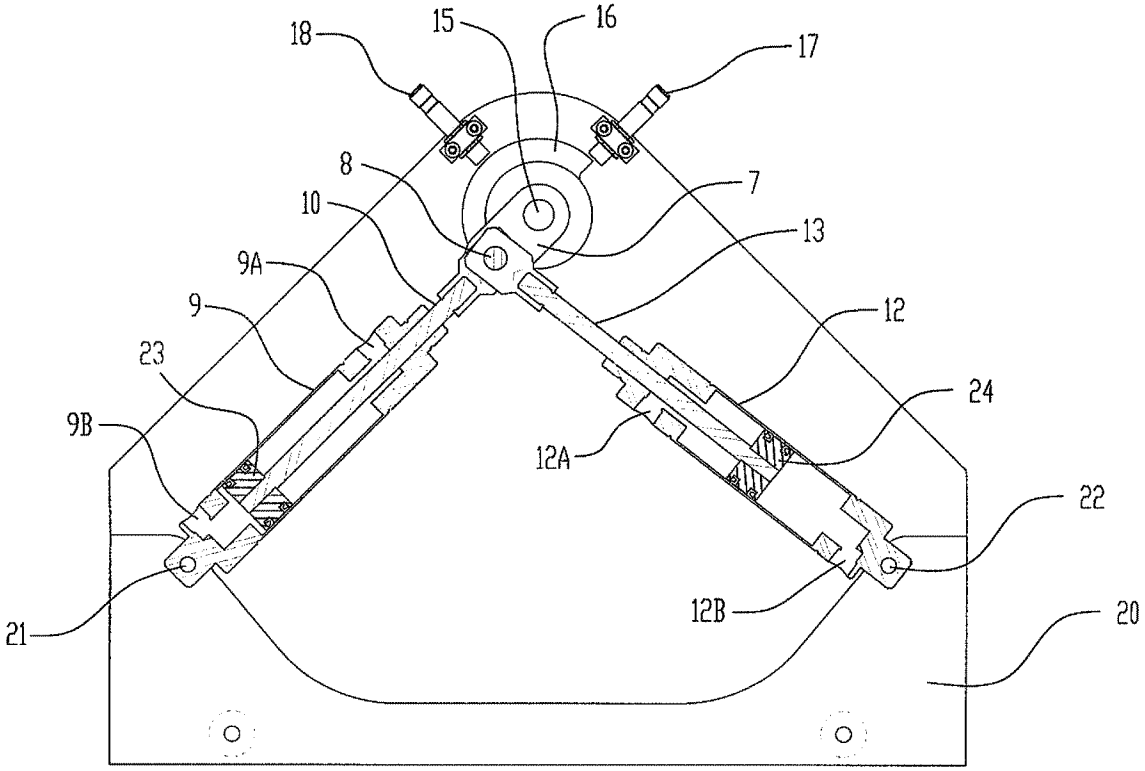
FIG. 4 is a cross-section of the two cylinder preferred embodiment of this invention showing the crank arm at the 7 o-clock position.

Referring to FIG. 4, it can be seen that applying pressure at port 12B at the lower end of hydraulic cylinder 12 would result in pressure on the face of hydraulic cylinder piston 24. That pressure would result in a force in line with the hydraulic cylinder axis being applied to the cylinder rod 13, through the rod end 14, and to the crank arm shaft 8 that is perpendicular to the crank arm 7. This force results in a clockwise torque on the drive shaft 15. Likewise, a pressure applied at port 12A at the upper end (commonly known as the rod end) of hydraulic cylinder 12 would result in a counterclockwise torque on the drive shaft 15. Because hydraulic cylinder 9 is in alignment with the crank arm 7 in FIG. 4, pressure applied to either side of piston 23 would not result in any torque being applied to the drive shaft 15. Assuming that the drive shaft 15 is rotating clockwise, and looking at the relationship of the drive shaft position indicator disc 16 and the two sensors 17 & 18 you can see that sensor 18 would be on and sensor 17 would be transitioning from off to on.

Figure 5:
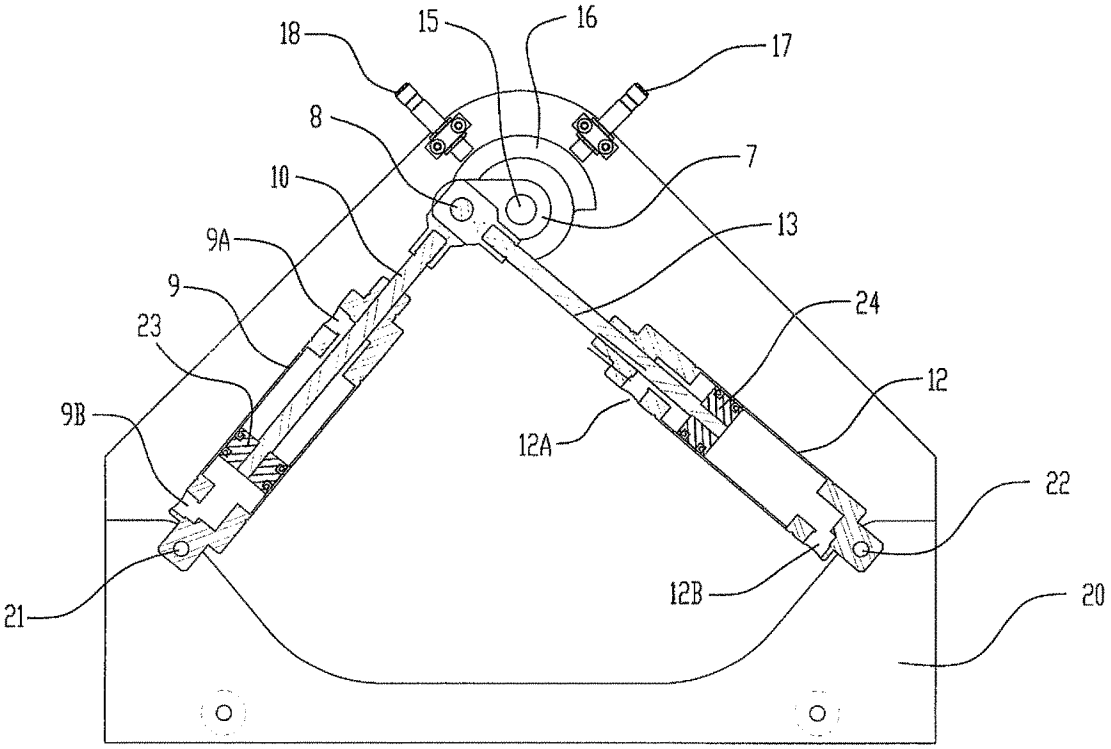
FIG. 5 is a cross-section of the two cylinder preferred embodiment of this invention showing the crank arm at the 9 o-clock position.

Referring to FIG. 5, and looking at the relationship of the drive shaft position indicator disc 16 and the two sensors 17 & 18 you can see that both sensors 17 & 18 would be on. If the PLC is programmed such that the B ports of each hydraulic cylinder are pressurized whenever their corresponding sensor is on, and the A ports are pressurized whenever the corresponding sensor is off, you can see that both hydraulic cylinders 9 & 12 would be pushing on the crank arm shaft 8, resulting in both producing a clockwise torque on the drive shaft 15

Figure 6:
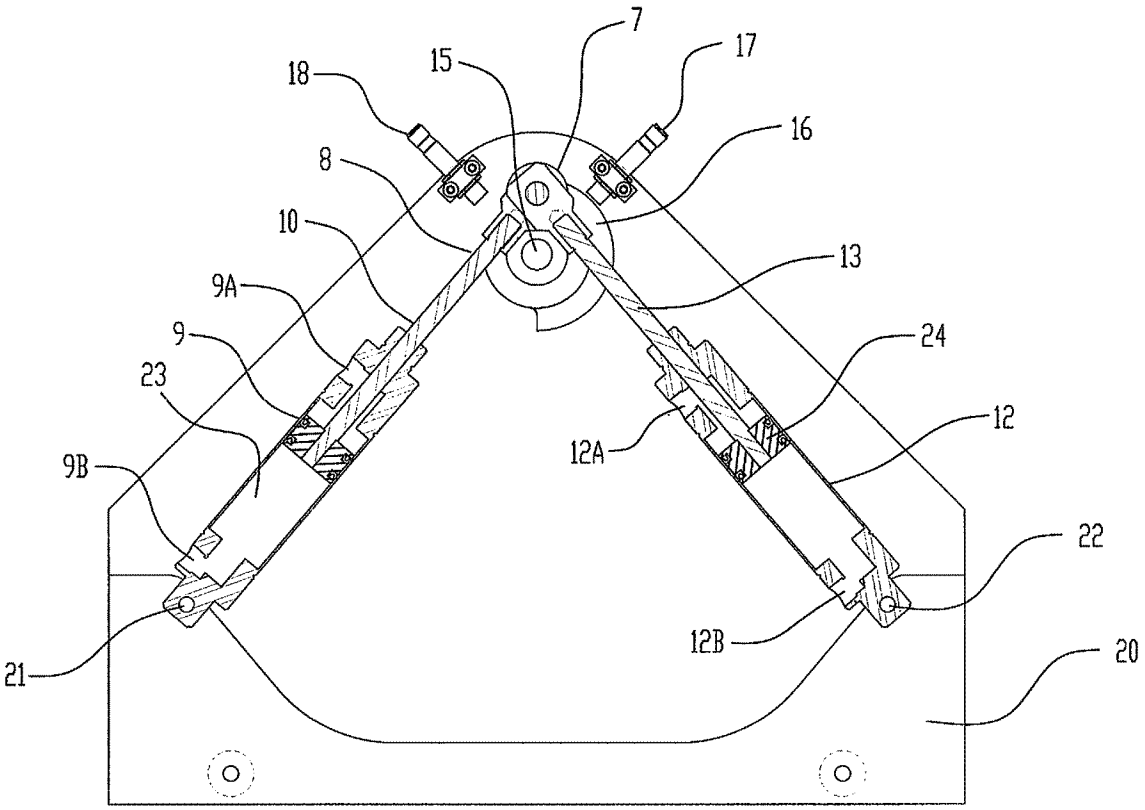
FIG. 6 is a cross-section of the two cylinder preferred embodiment of this invention with the crank arm at the 12 o-clock position.

Referring to FIG. 6, where the crank arm is rotated to a vertical position, the relationship of the drive shaft position indicator disc 16 and the two sensors 17 & 18 is such that sensor 17 is on and sensor 18 is off. With the PLC programmed such that the B ports of each hydraulic cylinder are pressurized whenever their corresponding sensor is on, and the A ports are pressurized whenever the corresponding sensor is off, you can see that hydraulic cylinders 9 would be pushing, causing a clockwise torque while hydraulic cylinder 12 would be pulling, also causing in a clockwise torque on the drive shaft 15

From FIG. 4, FIG. 5, and FIG. 6, you can see that with the PLC programmed such that the B ports of each hydraulic cylinder are pressurized whenever their corresponding sensor is on, and the A ports are pressurized whenever the corresponding sensor is off, the drive shaft 15 would rotate clockwise continuously. Likewise, if the logic is reversed such that the A ports of each hydraulic cylinder are pressurized whenever their corresponding sensor is on, and the B ports are pressurized whenever the corresponding sensor is off, the drive shaft 15 will rotate counterclockwise continuously.

Figure 7:
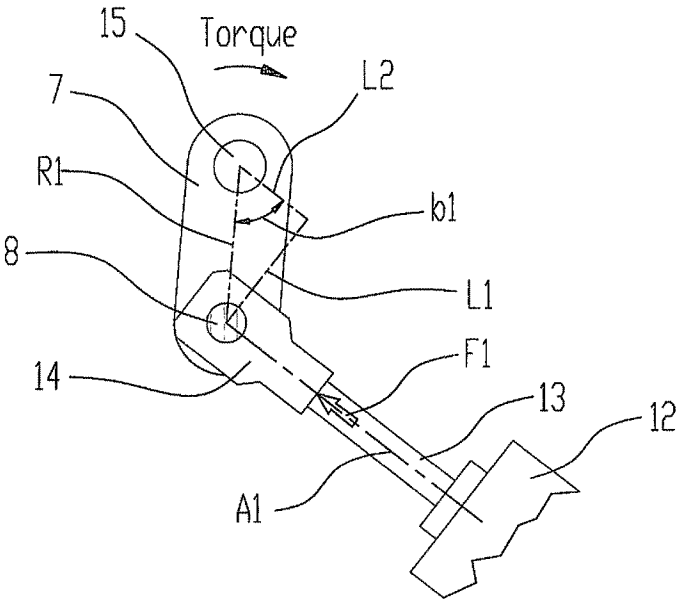
FIG. 7 shows the rod end and crank geometry and how torque is calculated.

The amount of torque supplied by each hydraulic cylinder at any position of the drive shaft can be calculated as the force of the cylinder multiplied by the component of the distance between the crank arm shaft and the center line of the drive shaft that is perpendicular to the line of action of the cylinder. Referring to FIG. 7, the direction of force applied to the crank arm shaft 8 by the hydraulic cylinder rod end 14 is represented by the arrow F1 and the distance between the crank arm shaft 8 and the center line of the drive shaft 15 that is perpendicular to the axis A1 of the hydraulic cylinder is represented by line L1. With line L2 being parallel to the axis A1 of the hydraulic cylinder, the length of line L1 can be calculated as the radius R1 of the swing of the crank arm 7 about the centerline of the drive shaft 15 multiplied by the sine of the angle b1 between line R1 and line L2.

As the drive shaft rotates, the torque supplied by the hydraulic cylinder 12 will vary as the sine of the angle between the direction of the crank arm 7 and the axis of the hydraulic cylinder 12 with a maximum torque equal to the hydraulic cylinder force F1 multiplied by the radius of the swing R1 of the crank arm shaft 8 and a minimum torque of zero. With two cylinders mounted perpendicular to each other driving the same crank arm shaft as shown in FIGS. 2 through 6, the torque supplied by the hydraulic cylinders 9 & 12 will vary with a maximum torque equal to the hydraulic cylinder force F1 multiplied by the radius of swing R1 of the crank arm shaft 8 multiplied by 1.414 and a minimum torque of F1 multiplied by R1. For simplicity sake, we have ignored the fact that a hydraulic cylinder has a slightly lower force while retracting than while extending.

With the extremely high forces that hydraulic cylinders can produce, the torque that this system can produce is quite large, suitable for machines such as large industrial shredders. As an example, with two 6 inch diameter hydraulic cylinders, a swing radius of the crank arm of 12 inches and a system pressure of 3,000 psi, the minimum torque is over 80,000 foot-pounds.

Figure 8:
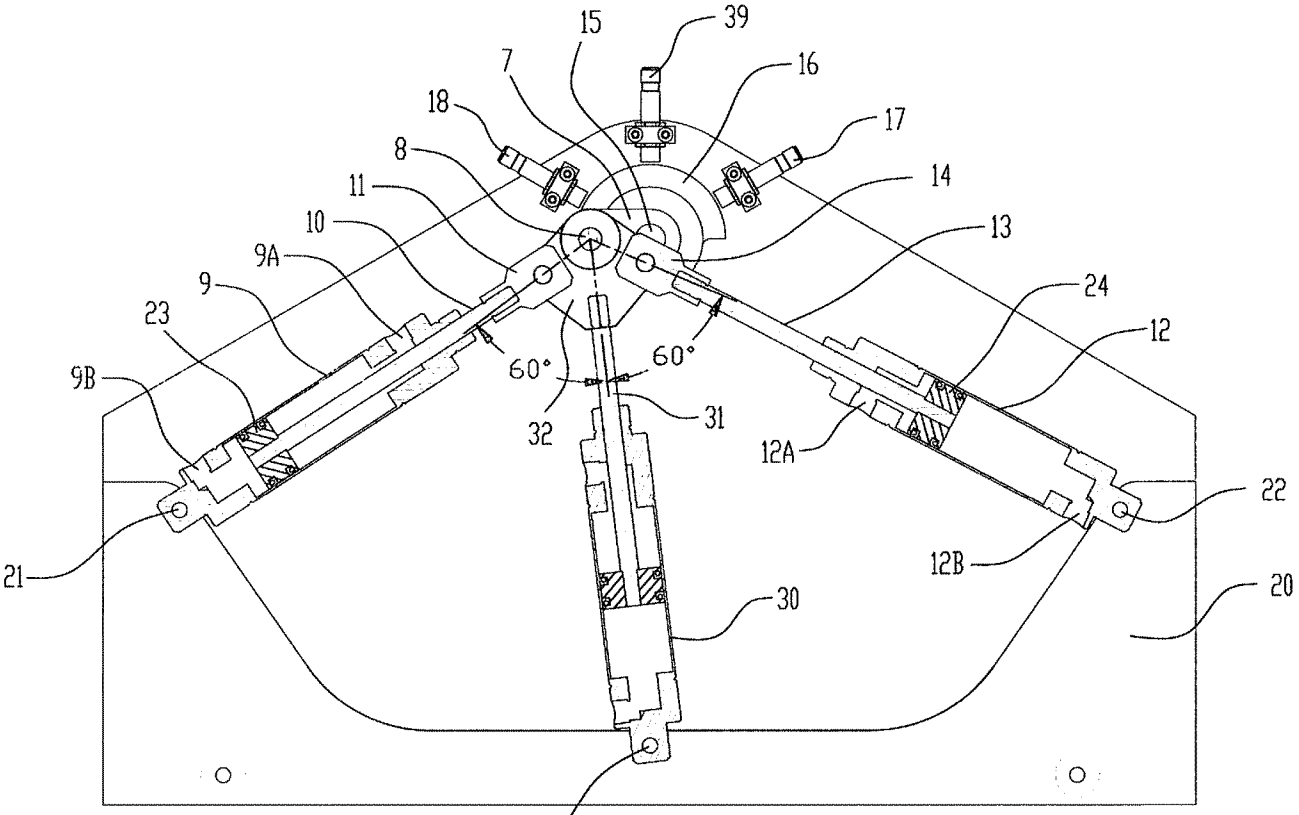
FIG. 8 is a cross-section of the three cylinder preferred embodiment.

This invention is not limited to just two hydraulic cylinders. It also works with three or more hydraulic cylinders as shown in FIG. 8. The addition of hydraulic cylinder 30 also requires the addition of another direction control valve and another position sensor 39. With three hydraulic cylinders, the optimum arrangement would be to space the hydraulic cylinders apart by 60 degrees instead of the 90 degrees used in the two hydraulic cylinder arrangement. The advantage of configurations using more hydraulic cylinders is that the variation in the torque supplied is less. As an example, in a three hydraulic cylinder configuration the variation in torque is 33 percent instead of the 41 percent variation of a two hydraulic cylinder configuration. FIG. 8 also shows using a master rod end 32 on hydraulic cylinder 30 with the rod end 11 of hydraulic cylinder 9 and rod end 14 of hydraulic cylinder 12 connected to the master rod end 32 instead of being directly connected to the crank arm shaft 8. In this arrangement the rod ends 11 & 14 only pivot a few degrees in master rod end 32, while the shaft 8 rotates 360 degrees in rod end 32. Along with saving space and shortening the length required for shaft 8, this arrangement reduces cost by taking away the need for roller bearings in rod ends 11 & 14.

Figure 9:
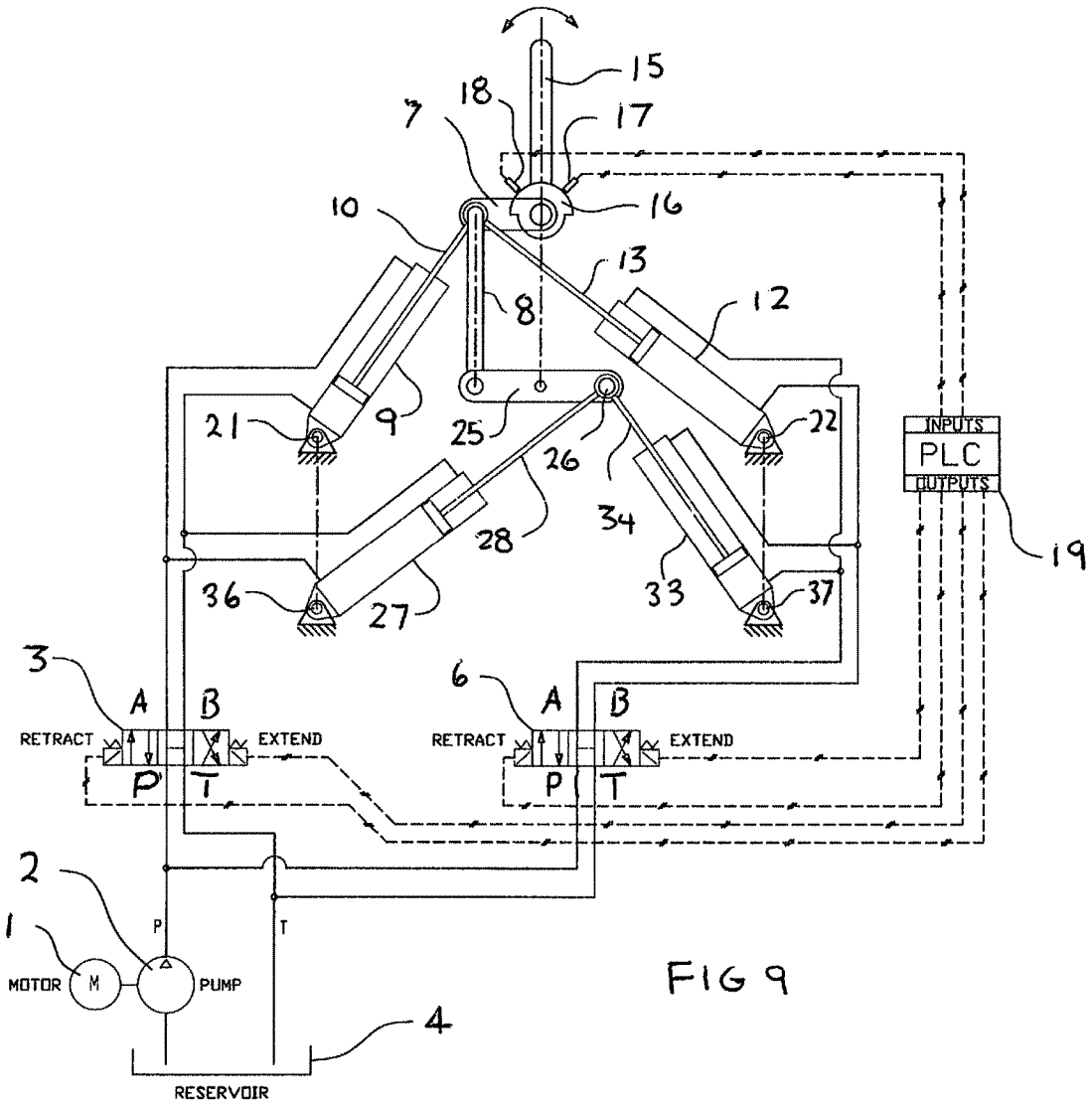
FIG. 9 is a simplified hydraulic schematic of the four cylinder preferred embodiment.
Figure 10:
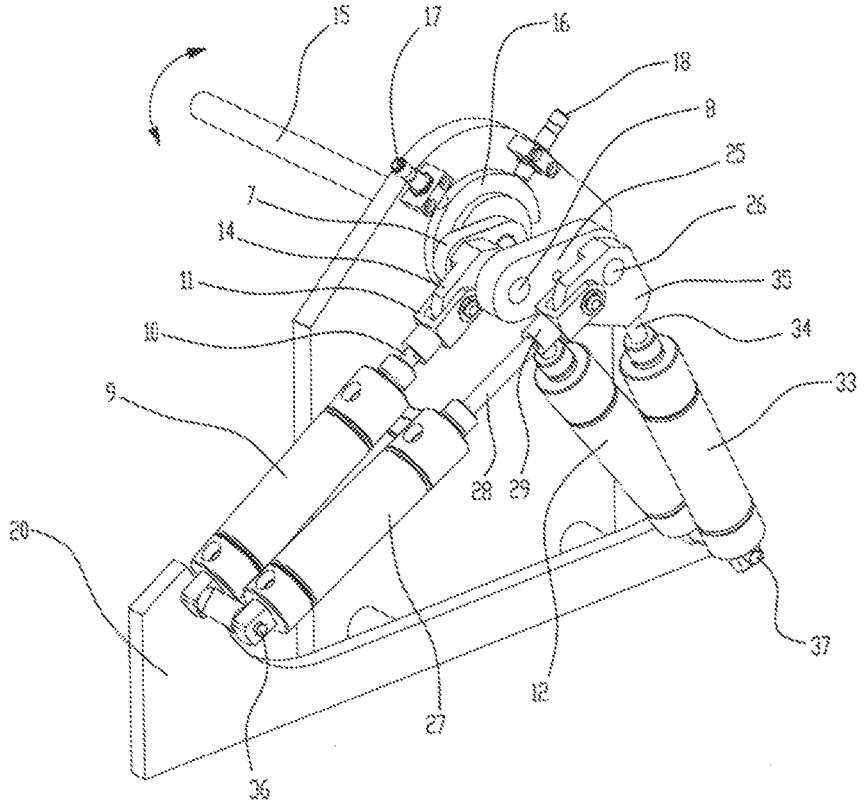
FIG. 10 is an isometric view of the four cylinder preferred embodiment.

In the preferred configuration as shown in FIG. 9 and FIG. 10, four cylinders are used, arranged in two pairs, with each pair being supplied by a single direction control valve. In this arrangement the crank arm shaft 8 is extended and connected to a second crank arm 25 which has attached to it shaft 26. The crank arm 25 is fixed to shaft 8 such that the shaft 26 is the same distance away from the drive shaft 15 axis as shaft 8 and it is 180 degrees out of phase with shaft 8. Referring to FIG. 10, rotationally attached to the shaft 26 is the master rod end 35 which is connected to hydraulic cylinder rod 34. Like the three cylinder configuration of FIG. 8, the rod end 29 is connected to the master rod end 35 instead of the shaft 26. Hydraulic cylinder 27 is connected to the frame by a pivot pin 36 which is on the same axis as the pivot pin 21 for hydraulic cylinder 9. As can be seen in FIG. 9, the hydraulic line that feeds the base port of hydraulic cylinder 9, also feeds the rod end of hydraulic cylinder 27 and the hydraulic line that feeds the rod end of hydraulic cylinder 9, also feeds the base end of hydraulic cylinder 27. With these two hydraulic cylinders connected to the direction control valve 3, the two hydraulic cylinders will always be applying force to the crank arm shafts in opposite directions, one pushing and one pulling, creating a torque couple. Likewise, hydraulic cylinder 33 is connected to the frame by a pivot pin 37 which is on the same axis as the pivot pin 22 for hydraulic cylinder 12. The hydraulic line that feeds the base port of hydraulic cylinder 12, also feeds the rod end of hydraulic cylinder 33 and the hydraulic line that feeds the rod end of hydraulic cylinder 12, also feeds the base end of hydraulic cylinder 33. With these two hydraulic cylinders connected to the direction control valve 6, the two hydraulic cylinders will also always be applying force to the crank arm shafts in opposite directions, one pushing and one pulling, creating a torque couple.

There are two distinct advantages that this configuration has over the two cylinder configuration: first, the four cylinders provide twice the torque without needing additional direction control valves and sensors; and second, each pair of hydraulic cylinders work together to create a very high torque couple, which puts very little side load on the drive shaft.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

Having thus described the invention, what is claimed as new and desired to be secured by Letters Patent is as follows:

1. A hydraulic cylinder drive system comprising:

a drive shaft for connection to a machine requiring a high torque, low speed rotational input, said drive shaft having a rotational midpoint;

a first crank arm having a proximate end and a distal end, said proximate end rigidly connected to said drive shaft and a first shaft extending from said distal end;

a rotational drive motor;

a fluid pump operatively connected to said drive motor;

at least one directional fluid control valve;

at least one pair of double acting hydraulic cylinders having a linear axis, a cylinder first end and a cylinder second end, said cylinder first end rotatably connected to said first shaft;

a fluid reservoir;

at least one programmable logic controller;

tubing connected between said fluid pump, said directional control valve, said pair of hydraulic cylinders and said reservoir so as to establish a hydraulic fluid circuit; and a positional sensing unit in operational connection with said crank arm, sending a first signal of said crank arm position to said programmable logic controller;

wherein said programmable logic controller receives said first signal from said positional sensing unit and generates and sends a second signal to said at least one directional control valve; and wherein said directional control valve directs hydraulic fluid to said hydraulic cylinders based on said second signals.

2. The hydraulic cylinder drive system of claim 1 further comprising hydraulic fluid, said hydraulic fluid contained within said hydraulic fluid circuit.

3. The hydraulic cylinder drive system of claim 1 wherein the number of directional control valves is two.

4. The hydraulic cylinder drive system of claim 3 further comprising a support base wherein each said hydraulic cylinder's second end is pivotally attached to said support base.

5. The hydraulic cylinder drive system of claim 1 wherein said linear axes of said double acting hydraulic cylinders have an included angle between them of approximately 90 degrees.

6. The hydraulic cylinder drive system of claim 1 further comprising:

two pairs of double acting hydraulic cylinders;

a second crank arm with a proximate end and a distal end, said proximate end connected to said first shaft and a second shaft extending from its distal end, said second shaft connected to said second pair of said hydraulic cylinders;

wherein said first crank arm and said second crank arm each have a linear axis, and wherein said linear axes are parallel and said first shaft and said second shaft are 180 degrees radially apart on a circle drawn about said rotational midpoint of said drive shaft.

7. A hydraulic cylinder drive system comprising:

a drive shaft for connection to a machine requiring a high torque, low speed rotational input, said drive shaft having a rotational midpoint;

a first crank arm having a proximate end and a distal end, said proximate end rigidly connected to said drive shaft and a first shaft extending from said distal end;

a rotational drive motor;

a fluid pump operatively connected to said drive motor;

two directional fluid control valves;

at least one pair of double acting hydraulic cylinders having a linear axis, an cylinder first end and a cylinder second end, said cylinder first end rotatably connected to said first shaft;

a fluid reservoir;

at least one programmable logic controller;

tubing connected between said fluid pump, said directional control valve, said pair of hydraulic cylinders and said reservoir so as to establish a hydraulic fluid circuit;

a positional sensing unit in operational connection with said crank arm, sending a first signal of said crank arm position to said programmable logic controller; and a support base wherein each said hydraulic cylinder's second end is pivotally attached to said support base;

wherein said programmable logic controller receives said first signal from said positional sensing unit and generates and sends a second signal to said at least one directional control valve; and wherein said directional control valve directs hydraulic fluid to said hydraulic cylinders based on said second signals; and wherein said positional sensing unit comprises:

a drive shaft position indicator located at said crank arm;

at least one positional sensor adjacent to said drive shaft and determining said drive shaft and crank arm position from the location of said drive shaft position indicator; wherein said positional sensor is in communication with said programmable logic controller so as to relay drive shaft and crank arm positional data to said programmable logic controller.

8. The hydraulic cylinder drive system of claim 7 wherein said linear axes of said double acting hydraulic cylinders have an included angle between them of approximately 90 degrees.

9. The hydraulic cylinder drive system of claim 6 wherein said linear axes of the double acting hydraulic cylinders in each pair, have an included angle between them of approximately 90 degrees.

* * * * *